US005079050A

United States Patent [19]

Harry et al.

[11] Patent Number: 5,079,050

[45] Date of Patent: Jan. 7, 1992

[54] CONTAINER FOR CORROSIVE MATERIAL

[75] Inventors: John O. Harry; George Verhagen, both of Green Bay, Wis.

[73] Assignee: Corrosion Technology, Inc., Green Bay, Wis.

[21] Appl. No.: 442,593

[22] Filed: Nov. 29, 1989

[51] Int. Cl.[5] ..... F06B 3/24; B32B 17/00; B32B 5/16; C25D 17/02

[52] U.S. Cl. ..... 428/34.5; 428/36.4; 428/268; 428/282; 428/285; 428/286; 428/287; 428/288; 428/331; 428/325; 206/524.5; 204/279

[58] Field of Search ..... 204/279, 242, 106, 267–269; 206/524.5; 428/268, 282, 286–288, 331, 325, 34.5, 36.4

[56] References Cited

U.S. PATENT DOCUMENTS

| | | | |
|---|---|---|---|
| 2,816,070 | 12/1957 | Buchanan | 204/279 |
| 3,216,559 | 11/1965 | Forbes et al. | 206/524.5 |
| 3,401,109 | 9/1968 | Anderson | 204/242 |
| 3,403,091 | 9/1968 | Currey et al. | 204/242 |
| 3,409,536 | 11/1968 | Barber et al. | 204/242 |
| 3,679,568 | 7/1972 | Westerlund | 204/279 |
| 3,682,809 | 8/1972 | Marquardson et al. | 204/275 |
| 3,763,083 | 10/1973 | Grotheer | 204/279 |
| 4,166,536 | 9/1979 | Roberts | 206/524.5 X |
| 4,213,842 | 7/1980 | Dufresne | 204/279 |
| 4,621,010 | 11/1986 | Wadsworth | 428/220 |
| 4,885,071 | 12/1989 | Harry et al. | 204/279 |
| 4,885,072 | 12/1989 | Harry et al. | 204/279 |

FOREIGN PATENT DOCUMENTS

| | | |
|---|---|---|
| 1177974 | 4/1959 | France . |
| 2162787 | 6/1988 | United Kingdom . |

OTHER PUBLICATIONS

High Quality EFCO Form Produces Complicated Concrete Structures in Form Marks, Spring/Summer 1982.

Intercompany Telex of AT&T Nassau Metals, S. Carouna, U.S.A., Electrolytic Cells at Cominco's Lead and Zinc Operations Report.

*Primary Examiner*—Donald R. Valentine

[57] ABSTRACT

A container in which minerals such as copper are purified in an electrolytic process includes bottom, end and side walls for containing a corrosive electrolyte, such as, a sulphuric or hydrochloric acid solution. The bottom, end and side walls of the container are composed of a cured mixture of 10–19 percent of a modified, vinylester or polyester thermo-setting resin and the balance consisting of aggregate. The surfaces of the container are coated with a resin layer having a backing layer consisting of about 70%–80% resin and 20%–30% a reinforcement which may comprise a fiber glass mat of non-continuous strands ½"–2" long or a light cloth of fiber glass or other synthetic fiber.

15 Claims, 1 Drawing Sheet

CONTAINER FOR CORROSIVE MATERIAL

BACKGROUND OF THE INVENTION

This invention relates to containers for highly corrosive solutions and more particularly to containers for use in the electrolytic refinement or electrowinning of metals such as copper.

In one type of process for the refinement of metals such as copper, a substantially pure copper anode is immersed in a suitable electrolyte, such as, a hydrochloric or sulphuric acid solution. The copper is deposited in a pure form on a cathode when an electric current is passed between the electrodes.

One type of prior art container employed for such electrolytic cells consists of a concrete shell having iron reinforcing bars and a lead or plastic liner. Such containers were not wholly satisfactory because the linings often failed resulting in concrete failure before the leaks were detected resulting in the loss of slimes and electrolyte. For this reason, prior art concrete cells required high maintenance, high repair and replacement costs and caused excessive downtime and lost production. In addition, the iron reinforcing bars provide a leakage path for stray electric currents which reduced current efficiency and affected cathode quality. Furthermore, because prior cells tended to absorb highly toxic materials, environmental concerns result in high disposal costs.

One prior art effort to improve such electrolytic cells included a shell fabricated from a mixture of about 20 percent resin and 80 percent various aggregates such as pea size gravel, fine silica sand, silica flour and one-quarter to one-eighth inch chopped fiber glass strands. These prior art cells had the disadvantage of relatively high fabrication costs, and a susceptibility to short circuiting as a result of the use of reinforcing rods which include ferrous materials. Another disadvantage of prior art cells was that the molding process by which they were formed resulted in cold joints, irregular internal surfaces and required that overflow boxes be separately attached.

Another electrolytic cell is disclosed in our application serial No. 253,045, filed Oct. 4, 1988 now U.S. Pat. No. 4,885,072 and assigned to the assignee of the present invention. While this cell has been satisfactory, improved corrosion resistance is highly desirable.

SUMMARY OF THE INVENTION

It is an object of the invention to provide a new and improved container for electrolytic materials.

Another object of the invention is to provide containers for electrolytic materials which is highly corrosion resistant.

A further object of the invention is to provide a container for electrolytic cells which has a longer life and lower maintenance costs and is easier to maintain and install than prior art cells.

These and other objects and advantages of the present invention will become more apparent from the detailed description thereof.

In general terms, one aspect of the invention comprises a container for an electrolytic process consisting of a cured mixture of 10% to 19% by weight vinylester or polyester thermosetting resin modified by the addition of a thinning agent, inhibitors, promoters and catalyst and the balance an aggregate, preferably consisting of crystalline silica particles and particles taken from the group consisting of glass beads, chopped fiber glass strands and mica flakes. The surfaces of the cell are coated with a coating consisting of a top layer of pure resin and a reinforcement comprising about 20%-30% fiber glass mat or light cloth and about 70%-80% resin.

According to another aspect, the invention comprises a method of molding a container for an electrolytic process comprising the steps of lining the surfaces of a mold which defines bottom, ends and side walls with a coating consisting of a backing layer of 20%-30% inorganic fiber reinforcement and 70%-80% of pure polyester or vinylester thermosetting resin and a top layer of pure polyester or vinylester resin, mixing 10% -19% by weight of a vinylester or polyester thermosetting resin modified by the addition of a thinning agent, inhibitors, promoters and catalyst and the balance consisting of an aggregate, continuously pouring the mixture into the mold and allowing said molded mixture and coating to cure.

DETAILED DESCRIPTION OF THE PREFERRED EMBODIMENT

Figure 2:
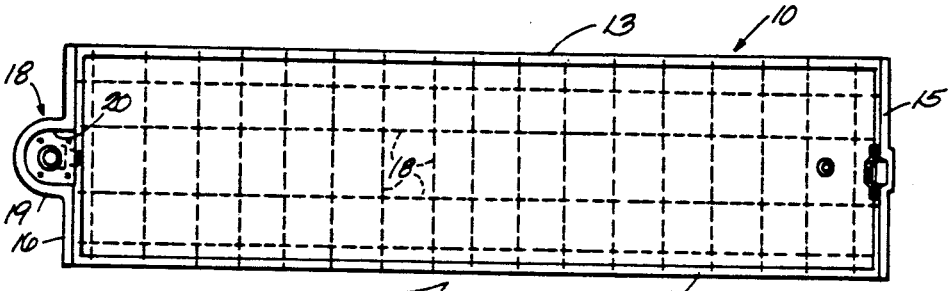
FIG. 2 is a top plan view thereof.
Figure 1:
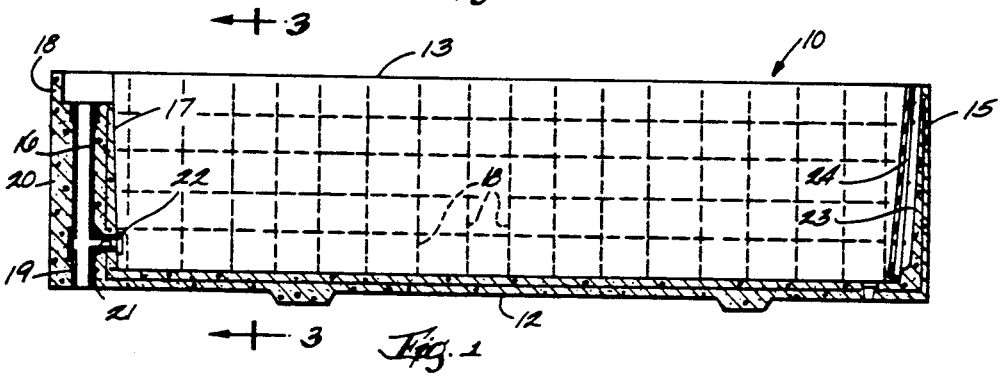
FIG. 1 is a side elevational view partly in section showing a cell according to my invention.
Figure 4:
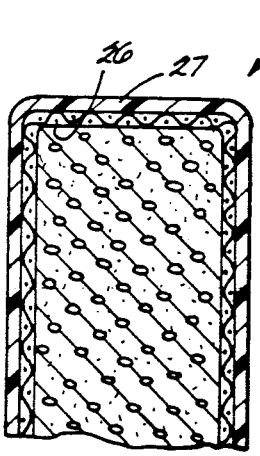
FIG. 4 is an enlarged fragmentary sectional view.

The invention relates to a cell for containing a corrosive liquid such as the electrolyte employed in an electroplating operation. As those skilled in the art will appreciate, electrolytic cells employed for purifying metals, such as copper, consist of a container for an electrolyte, such as a sulfuric or hydrochloric acid solution. One process uses an anode consisting of relatively pure copper, i.e., about 99% copper, and a starter sheet of a purer copper or other suitable material, which are immersed in an electrolyte. The anode and starter sheet or cathode are placed in series with an electrical energy source so that the passage of current between the anode and cathode and through the electrolyte causes copper ions to flow from the anode through the electrolyte to the cathode. This provides a body of copper at the cathode which is 99.9% pure. Precious metals such as gold, silver, platinum, and other metals and by products collect in a sludge which forms at the bottom of the cell.

A cell 10 according to the invention is shown in the drawings to include a bottom 12, side walls 13 and 14 and end walls 15 and 16. The surfaces of the cell is coated with a corrosion resistant lining 17. An overflow box 18 is integrally cast on end wall 16. The walls 13, 14, 15 and 16 taper from bottom to top as molded. An open ended, vertically oriented overflow pipe 19 is disposed in a bulge 20 in end wall 16 and communicates at its upper end with overflow box 18. In addition, a short, horizontally extending decanting pipe 21 extends between the interior of cell 10 and the overflow pipe 19. A plug 22 normally disposed in pipe 21, can be removed for decanting. At the opposite end of the cell 10 there is an inlet channel 23 formed on the inner surface of wall 15 and having a spaced cover plate 24 which define a vertical passage having openings at its opposite ends.

A matrix of reinforcing bars 19, of a nonconductive material, such as FRP fiber glass, is disposed in the bottom 12 and extends partially or totally up the side and end walls 13, 14, 15 and 16.

Electrolytic cells of the type discussed above must be nonporous and possess sufficient mechanical strength and must be chemically inert relative to the electrolyte which comprises a sulfuric or hydrochloric acid solution. One example of a cell with which the present invention may be used comprises a mixture of 10%-19% by weight of a modified vinylester or polyester thermosetting resin, and the balance consists of a mixture of crystalline silica particles, and particles taken from the group consisting of mica flakes, glass beads and chopped fiber glass strands. The vinylester or polyester resin is thinned to reduce viscosity and permit higher filler loading. The viscosity of the vinylester or polyester resin should be less than 200 CPS as measured by a Brookfield viscosity meter Model LVT at 77° F. with a 13 spindle at 60 RPM. According to one example, the components by weight of the modified vinylester resin are as follows:

80%-90% vinylester resin;
10%-20% styrene monomer (thinner); 1%-5% degassing agent;
0.2%-2% methyl ethyl ketone peroxide, or cumene hydroperoxide (catalyst);
0.05%-0.2% inhibitor;
0.2%-0.6% cobalt napthalate (6%) (promoter)
0.02%-0.5% dimethyl aniline (100%) (promoter);

Any suitable inhibitor, such as 2.4 pentanedione may be employed and any suitable degassing agent such as xylene or acetone may be used.

The dry mixture comprises:

40%-60% ⅛"-¼" crystalline silica
10%-25% 1/16"-¼" crystalline silica
10%-15% 1/32"-1/16" crystalline silica
10%-15% fine silica sand
1% mica flakes Chopped fiber glass strands ¼"-⅛" or glass spheres can be substituted for the mica flakes. The proportions of resin and dry ingredients by weight in the final mixture, according to the preferred embodiment of the invention, are as follows:

10%-19% modified vinylester or polyester resin
40%-60% ⅛"×¼" crystalline silica
10%-25% 1/16"×⅛" crystalline silica
10%-15% 1/32"×1/16" crystalline silica
10%-15% fine silica sand or silica flour
0.9%-5% mica flakes, ¼"-⅛" chopped fiber glass strands, and/or glass spheres In one specific example a resin mixture was prepared with the following ingredients:

450 pounds vinylester resin;
85 pounds styrene monomer;
13 pounds xylene;
1.5 pounds methyl ethyl ketone peroxide;
15 ounces pentanedione;
22 ounces cobalt napthalate;
22 ounces dimethyl aniline Twenty-five pounds of the foregoing modified resin mixture was then mixed with the following quantities of dry ingredients:

100 pounds ⅛"-¼" crystalline silica
40 pounds 1/16"-⅛" crystalline silica
20 pounds 1/32"-1/16" crystalline silica
20 pounds fine silica sand
2 pounds mica flakes, chopped fiber glass strands ¼" to ⅛" or glass spheres can be substituted for the mica flakes The resin acts as a binder for the dry materials and fills the interstices therebetween so that the container is impervious to the electrolyte solution and forms a corrosion-resistant material unaffected by the electrolyte solution. The chopped fiber glass strands, mica and/or glass spheres provide a tighter composite material which also reduces porosity and increases physical strength. The nonconductor reinforcing bars increase physical strength and allow the cells to be supported in only two areas if necessary.

Figure 3:
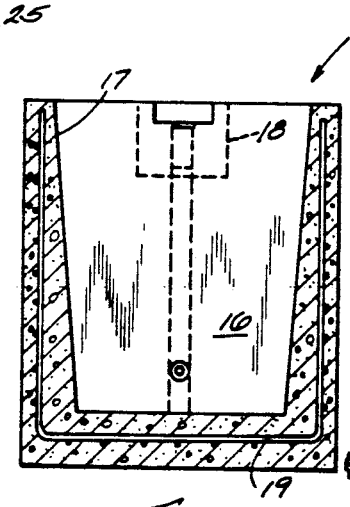
FIG. 3 is a view taken along lines 3—3 of FIG. 2.

In order to further enhance the corrosion resistance of the cell 10, a corrosion resistant coating 17 is provided. According to the preferred embodiment, coating 25, consists of a backing layer 26 consisting of 20%-30% by weight of an inorganic fiber reinforcement and 70%-80% by weight of pure polyester or vinylester resin. The fiber reinforcement may be a mat of fiber glass strands ½"-2" long or a light cloth of fiber glass or other synthetic fiber. One such material is called Nexus veil. In addition, there is a surface coating 27 of vinylester or polyester resin which is 10-20 mils thick. It will be appreciated that the thickness of the layer 26 and the coating 27 are much exagerated in FIG. 3 and for purposes of illustration. In actual practice, the walls 13, 14 and 15 are about 2.5"-3.5" thick while the thickness of coating 27 is 10-20 mils.

Figure 5:
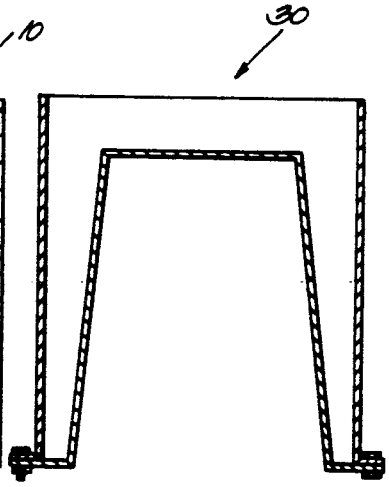
FIG. 5 is a sectional view of a mold in which the cell according to the invention is fabricated.

It was the practice to pour prior art cells in an upright mold. Because the inside bottom, side and end walls of the cell must be smooth to facilitate removal of the sludge, one common practice in molding prior art cells was to pour and trowel the bottom surface before continuing to pour the side and end walls. This sometimes resulted in a cold joint which adversely affected the physical strength of the cell and produced areas of leakage. In the method according to the invention, an inverted mold 30 as shown in FIG. 5 is used to fabricate the cell 10.

The container according to the preferred embodiment of the invention is formed by applying to the surface of the mold a face coating of polyester or vinylester thermosetting resin 10-20 mils thick, applying to the coating a backing layer of about 20%-30% by weight of an inorganic fiber reinforcement and about 70%-80% by weight pure polyester or vinylester resin, mixing polyester or vinylester resin and dry ingredients and then pouring the same continuously into the inverted mold 30 and onto said backing layer. In order to insure that the face coating 27 adheres to the surface of the mold 30, it is applied in the form of a gel coating either by spraying or rolling. One material that has been used successfully is Grey Vinylester, code AG-00003B sold by Co-Plas, Inc. The fiber reinforcement may comprise a fiber glass mat formed of strands ½"-2" long or a light cloth of fiber glass or other synthetic material.

The mixture, backing layer 26 and face coating 27 are then allowed to cure at room temperatures. Because an inverted mold is used, the inside bottom, side and end wall surfaces of the face coating are in contact with a smooth mold surface. Accordingly, these surfaces will also be relatively smooth without troweling. This permits continuous casting of the cell to insure that no cold joints are formed.

Casting the cell upside down also facilitates the casting of an integral overflow box with the cell. As a result, greater physical strength is achieved over prior art cells where the overflow box was cast separately and then attached to the cell. This prior art method caused leaks and made the overflow box susceptible to mechanical damage.

Because of the strength of the cell made in accordance with the mixture and reinforcing bars discussed above, a cell wall thickness of about two and one half inches at the top and three and one half inches at the bottom is satisfactory for a conventional cell which is about sixteen feet in length, four and one half feet in height and four and one half feet in width. Conventional concrete cells have a wall thickness of about five to six inches. As a result, cells made in accordance with the present invention provides cells with a greater internal capacity for the same outside dimensions. Since the one factor in determining the electrorefining capacity of a refining facility is by the number of cells and their capacity, the use of cells having thinner walls significantly increases total plant capacity. A typical electrolytic refinery has capacity of approximately 120,000 tons per year. This capacity could increase, for example, by approximately 7,000,000 Pounds Per year with the additional internal cell capacity.

While the life expectancy of cells according to the present invention has not as yet been determined, it is estimated that as a result of their physical strength, impermeability and non-conductiveness, their useful life will be much longer than conventional concrete cells. In addition, any physical damage to cells according to the invention can be more readily repaired than prior art concrete cells, thereby reducing maintenance costs and production downtime.

The operating temperature of some prior art cells was limited to about 160° F. because the plastic linings employed tended to lose shape and reduce useful life at higher temperatures. With the cell according to the present invention, coupled with the use of nonconducting reinforcing rods, higher current densities and temperatures can be employed, thereby increasing production rates, quality and capacity.

Bars of elongate and preformed nonconductive material, such as, for example, precured fiber glass are preferably inserted into the bottom and side walls and corners of bottom-side and bottom-end wall corners of the container as the same is being poured thereby substantially increasing the physical strength properties and minimizing the possibility of electrical short-circuiting due to the use of metallic reinforcing bars in prior art containers. Such reinforcing lap boards which support the bars permit the electrodes to be mounted directly on the cell wall, thereby eliminating the necessity for an insulating board as in prior art devices.

While only a single embodiment of the invention is described herein, it is not intended to be limited thereby but only by the scope of the appended claims.

I claim:

1. A container for a corrosive electrolyte used in an electrolytic process, said container including a shell formed from a mixture of an inorganic aggregate and a thermosetting resin taken from the group consisting of a vinylester resin and a polyester resin, a backing layer of an inorganic fiber impregnated with a thermosetting resin taken from the group consisting of a vinylester resin and a polyester resin overlying the surface of said shell and a face layer consisting essentially of a vinylester or a polyester thermosetting resin overlying said backing layer, said backing layer being applied to the surface said shell and said backing layer and said face layer and said backing layer being to each other while the thermosetting resins in said shell, said backing layer and said face layer are in an uncured state so that thermosetting resins in all three cure together.

2. The container set forth in claim 1 wherein the face layer is about 10–20 mils thick.

3. The container set forth in claim 2 wherein said reinforcement bars extend through said bottom wall and at least partially up side wall and said end walls.

4. The container set forth in claim 1 wherein the backing layer includes about 20%–30% by weight fiber and about 70%–80% by weight resin.

5. The container set forth in claim 4 wherein said face layer is about 10–20 mils thick.

6. The container set forth in claim 5 wherein said mixture includes 10% to 19% by weight of said thermosetting resin.

7. The container set forth in claim 6 wherein the resin portion of said mixture comprises a modified resin including 80%–90% of said resin with the balance being a thinning agent, inhibitors, promoters and a catalyst.

8. The container set forth in claim 7 wherein said aggregate comprises 40%–60% by weight crystalline silica particles ¼"–⅛" in size, 10%–25% by weight crystalline silica particles ⅛"–1/16" in size, 10%–15% by weight crystalline silica particles 1/16"–1/32" in size, 10%–15% fine silica sand or silica flour and 0.9%–5% by weight particles taken from the group consisting of mica flakes about 1/64" in size, ¼"–⅛" chopped fiber glass strands, ¼"–⅛" glass spheres and mixtures thereof.

9. The container set forth in claim 8 wherein said inorganic fiber is fiber glass in the form of a mat.

10. The container set forth in claim 9 wherein said mat is formed of strands ½"–2" long.

11. The container set forth in claim 4 wherein said inorganic fiber is fiber glass in the form of a mat.

12. The container set forth in claim 11 wherein said mat is formed of strands ½"–2" long.

13. The container set forth in claim 1 wherein said inorganic fiber is fiber glass in the form of a mat.

14. The container set forth in claim 13 wherein said mat is formed of strands ½"–2" long.

15. The container set forth in claim 1 wherein said shell has bottom, side and end walls and includes elongated reinforcement bars of a non-conductive material incorporated into said bottom, side and end walls.

* * * * *